US007532850B2

(12) United States Patent
Won

(10) Patent No.: US 7,532,850 B2
(45) Date of Patent: May 12, 2009

(54) DOCUMENT DISCHARGE CASSETTE, IMAGE SCANNER HAVING THE CASSETTE, AND DOCUMENT SCANNING METHOD

(75) Inventor: Jin-sik Won, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 401 days.

(21) Appl. No.: 11/341,688

(22) Filed: Jan. 30, 2006

(65) Prior Publication Data

US 2006/0171751 A1 Aug. 3, 2006

(30) Foreign Application Priority Data

Feb. 1, 2005 (KR) ..... 10-2005-0009097

(51) Int. Cl.
*G03G 15/00* (2006.01)
*B65H 5/22* (2006.01)

(52) U.S. Cl. ..... 399/365; 271/3.01; 271/212

(58) Field of Classification Search ..... 271/3.01, 271/3.14, 212; 414/794.9, 795.2, 795.3; 270/58; 399/365, 367
See application file for complete search history.

(56) References Cited

FOREIGN PATENT DOCUMENTS

| | | | |
|---|---|---|---|
| JP | 58-188261 | | 11/1983 |
| JP | 61-226427 | | 10/1986 |
| JP | 08282897 A | * | 10/1996 |
| JP | 2000-335811 | | 12/2000 |
| KR | 1994-11211 | | 6/1994 |
| KR | 20-156001 | | 6/1999 |
| KR | 20-358849 | | 8/2004 |

OTHER PUBLICATIONS

Office Action issued in Korean Patent Application No. 2005-9097 on Aug. 25, 2006.

* cited by examiner

*Primary Examiner*—Daniel J Colilla
*Assistant Examiner*—Allister Primo
(74) *Attorney, Agent, or Firm*—Stein, McEwen & Bui, LLP

(57) ABSTRACT

A document discharge cassette, an image scanner having the cassette, and a document scanning method to be embodied by the image scanner having the document discharge cassette attached thereto. The document discharge cassette includes a base, positioned under the document discharge exit provided at the scanner body and through which scanned documents are discharged, on which the discharged documents are stacked, and a document lift to lift a preceding document that is discharged through the document discharge exit higher than the document discharge exit relative to the base and to lower the preceding document on a following document that is discharged after the preceding document and placed at the base.

18 Claims, 8 Drawing Sheets

DOCUMENT DISCHARGE CASSETTE, IMAGE SCANNER HAVING THE CASSETTE, AND DOCUMENT SCANNING METHOD

CROSS-REFERENCE TO RELATED APPLICATIONS

This application claims the benefit of Korean Application No. 2005-9097, filed Feb. 1, 2005, in the Korean Intellectual Property Office, the disclosure of which is incorporated herein by reference.

BACKGROUND OF THE INVENTION

1. Field of the Invention

An aspect of the present invention relates to an image scanner scanning an image recorded on a document, and, more particularly, to a document discharge cassette that allows a speeding up of a scanning operation of both faces of the document, an image scanner having the cassette attached thereto, and a document scanning method to be embodied by the scanner having the document discharge cassette attached thereto.

2. Description of the Related Art

In general, an image scanner is a device that scans an image that is recorded on a document and reproduces the scanned image on another document or a display device. Image scanners may also include a digital copying machine, a facsimile, etc., attached thereto.

FIG. 1 is a cross-sectional view schematically illustrating an embodiment of a conventional image scanner that is able to scan both faces of a document. A conventional image scanner 10 includes an image sensor 25 to scan an image recorded on a document, a document feed cassette 12 to load a stack of documents to be fed, an automatic document feed (ADF) roller 15 to pick individual documents one by one from the top position of the stack of documents loaded in the document feed cassette 12 and to feed the picked up document inside a case, a registration roller 17 to align a tip of the fed document and to correct a misalignment of the document, a first feed roller 19 to transfer the aligned document toward the image sensor 25, a second feed roller 20 to pass the image sensor 25 and to transfer the document of which one face is scanned, a document discharge roller 27 to discharge the document of which an image is scanned, and a document discharge cassette 14 to stack the discharged document.

Further, the image scanner 10 includes a path changer 29 to change a document path to a duplex path 35 so as to allow the image scanner 10 to scan the other face of the document and a duplex roller 22 to transfer the document that is advanced into the duplex path 35.

When a plurality of documents are loaded into the document feed cassette 12 and a continuous image scanning operation of the documents is performed, the scanned documents are discharged into the document discharge cassette 14 in an order that is the reverse of the order the documents were loaded in. The reversal of the loading order between the document feed cassette 12 and the document discharge cassette 14 also occurs when the continuous image scanning operation is applied to both faces of the documents.

Specifically, the first document 1 loaded at the top position of the document feed cassette 12 is turned over and is stacked at the bottom of the document discharge cassette 14 after the image scanning operation. A first face 1-*i*, i.e., an upward face at the document feed cassette 12 and a second face 1-*ii*, i.e., a downward face are turned downward and upward, respectively at the document discharge cassette 14. Further, the second document 2 and the third document 3, sequentially loaded under the first document 1, at the document feed cassette 12 are sequentially stacked on the first document 1 at the document discharge cassette 14 after the image scanning operation, and first faces 2-*i* and 3-*i*, i.e., an upward face, and second faces 2-*ii* and 3-*ii*, i.e., a downward face at the document feed cassette 12, are turned over and become downward faces and upward faces, respectively, at the document discharge cassette 14.

However, according to the image scanning operation of the conventional image scanner, in order to apply the above order as the stacking order of documents to be stacked at the document discharge cassette 14 when scanning both faces of a document each document is made to pass along the duplex path 35 twice and by the image sensor 25 three times. As a result, since each document passes the duplex path 35 and the image sensor 25 one time before a discharging of the document, a pass which is, in fact, not related to image scanning, the scanning speed for both faces of the document is slowed, thereby causing additional electric power consumption. Further, there is a high possibility of a jam because a transfer path of the document is extended.

SUMMARY OF THE INVENTION

An aspect of the present invention provides a document discharge cassette that stacks a document discharged after scanning, in the same stacking order as when feeding the document.

An aspect of the present invention also provides an image scanner speeding up scanning both faces of the document with the document discharge cassette, and a document scanning method to be embodied by the image scanner.

According to an aspect of the present invention, there is provided a base, positioned under a document discharger through which documents are discharged face up, on which the discharged documents are stacked, and a document lift to lift a preceding discharged document higher than the document discharger relative to the base and to lower the preceding document on a following document that is discharged after the preceding document and placed at the base.

The document lift may comprise a pair of lift bodies to ascend and descend at both sides of the base, and a pair of document support plates coupled to each of the respective lift bodies with a hinge that rotates to a first position in which the document support plates are folded toward the respective lift bodies so that the document descends toward the base and a second position in which the document support plates are extended so that the document is supported above.

The document discharge cassette may further comprise a pinion gear to rotate clockwise and counterclockwise and a rack gear, provided at the lift body, to engage with the pinion gear, in order to cause the pair of lift bodies to ascend and descend.

The document discharge cassette may further comprise a pair of actuators to rotate each document support plate from the second position to the first position when activated.

The document discharge cassette may further comprise a pair of springs to restore each document support plate to the second position by an elastic force thereof.

According to another aspect of the present invention, there is provided image scanner comprising a document feed cassette loading a document to be scanned, a scanner body scanning both faces of the loaded document, and a document discharge cassette into which the document is discharged, wherein the document discharge cassette comprises a base, positioned under a document discharge exit provided at the scanner body and through which scanned documents are discharged, on which the discharged documents are stacked, and a document lift to lift a preceding document that is discharged through the document discharge exit higher than the document discharge exit relative to the base and to lower the preceding document on a following document that is discharged after the preceding document and placed at the base.

The document lift may comprise a pair of lift bodies to ascend and descend at both sides of the base, and a pair of document support plates coupled to each of the respective lift bodies with a hinge that rotates to a first position in which the document support plates are folded toward the lift bodies so that the document descends toward the base and a second position in which the document support plates are extended so that the document is supported above.

The document discharge cassette may further comprise a pinion gear to rotate clockwise and counterclockwise and a rack gear, provided at the lift body, to engage with the pinion gear, in order to cause the pair of lift bodies to ascend and descend.

The document discharge cassette may further comprise a pair of actuators to rotate each document support plate from the second position to the first position when activated.

The document discharge cassette may further comprise a pair of springs to restore each document support plate to the second position by an elastic force thereof.

The scanner body of the image scanner may comprise an image sensor facing a face of the document to scan an image recorded on the face, and wherein the document passes the image sensor only two times to scan both faces of the document and is discharged into the document discharge cassette.

According to still another aspect of the present invention, there is provided a document scanning method of feeding documents in order to a scanner body and scanning both faces of the documents, discharging each of the documents through a document discharge exit provided in the scanner body, and stacking the discharged documents at the base of a document discharge cassette, the method comprising lifting a preceding document that is initially placed at the base higher than the document discharge exit, and lowering the preceding document on a following document discharged after the preceding document and placed at the base.

An upward face and a downward face of a document fed to the scanner body face upward and downward, respectively, when the document is discharged through the document discharge exit.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
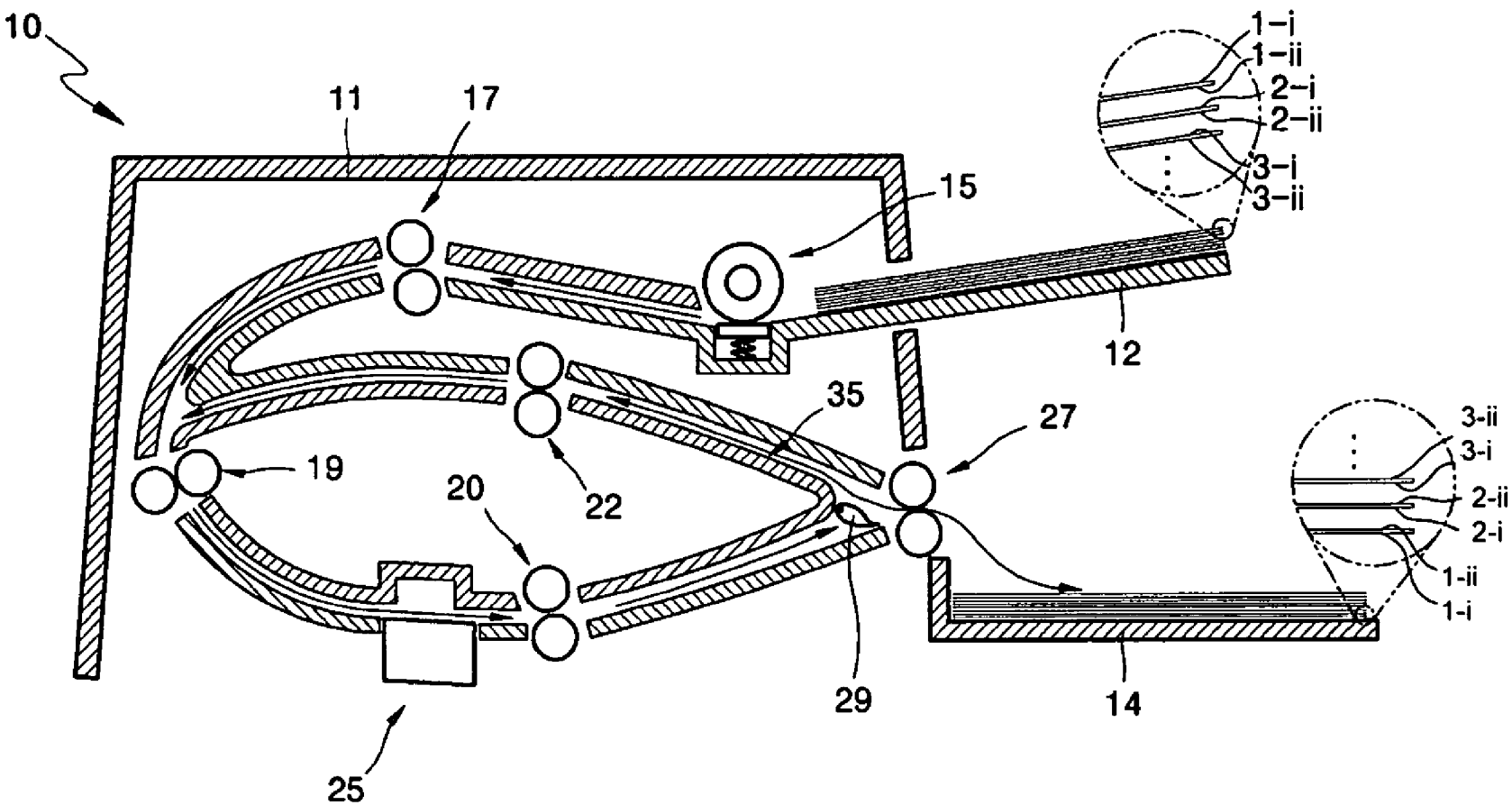
FIG. 1 (PRIOR ART)
FIG. 1 is a cross-sectional view schematically illustrating an embodiment of a conventional image scanner having a function of scanning both faces of a document.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
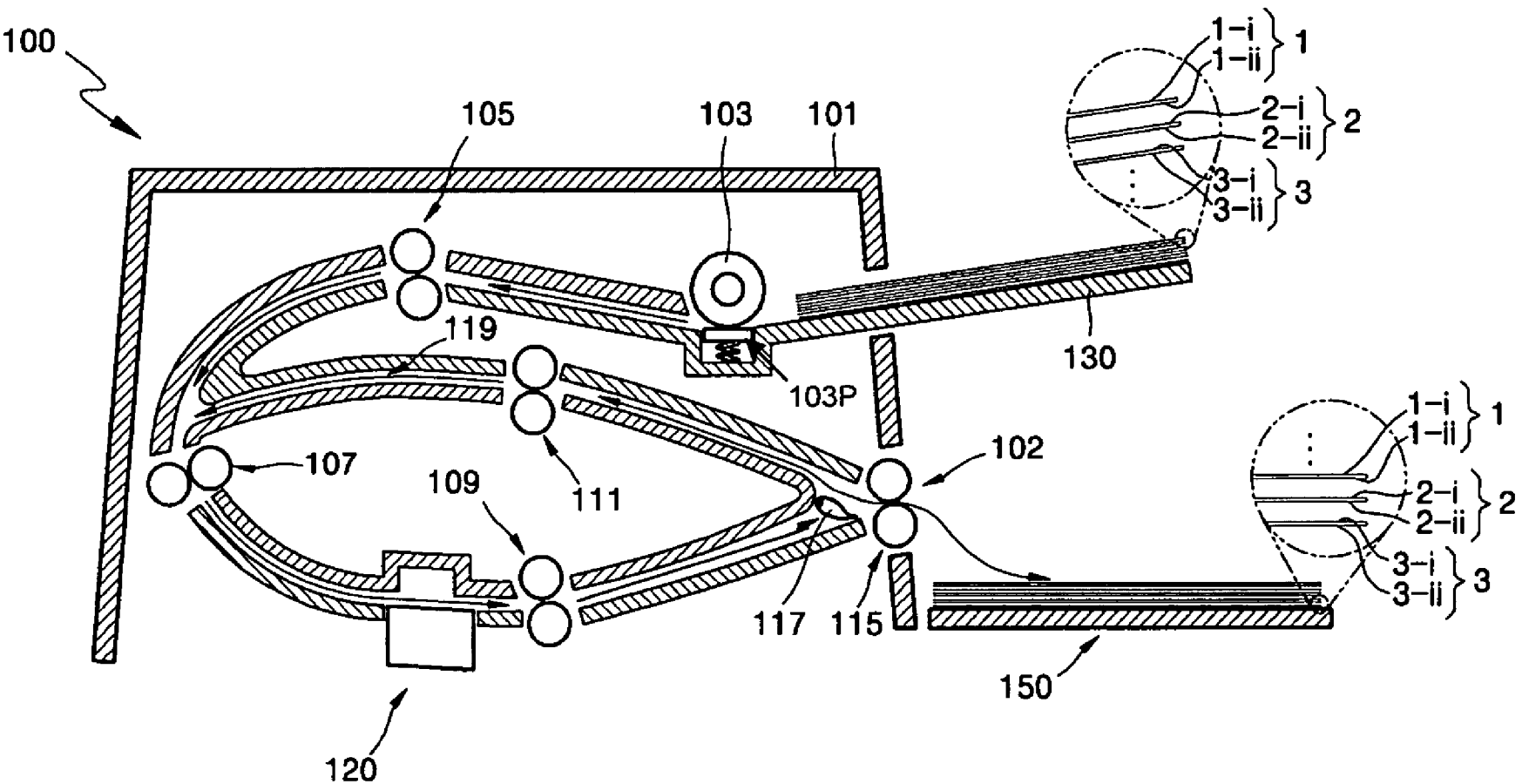
FIG. 2 is a cross-sectional view illustrating an image scanner according to an embodiment of the present invention.
Figure 3:
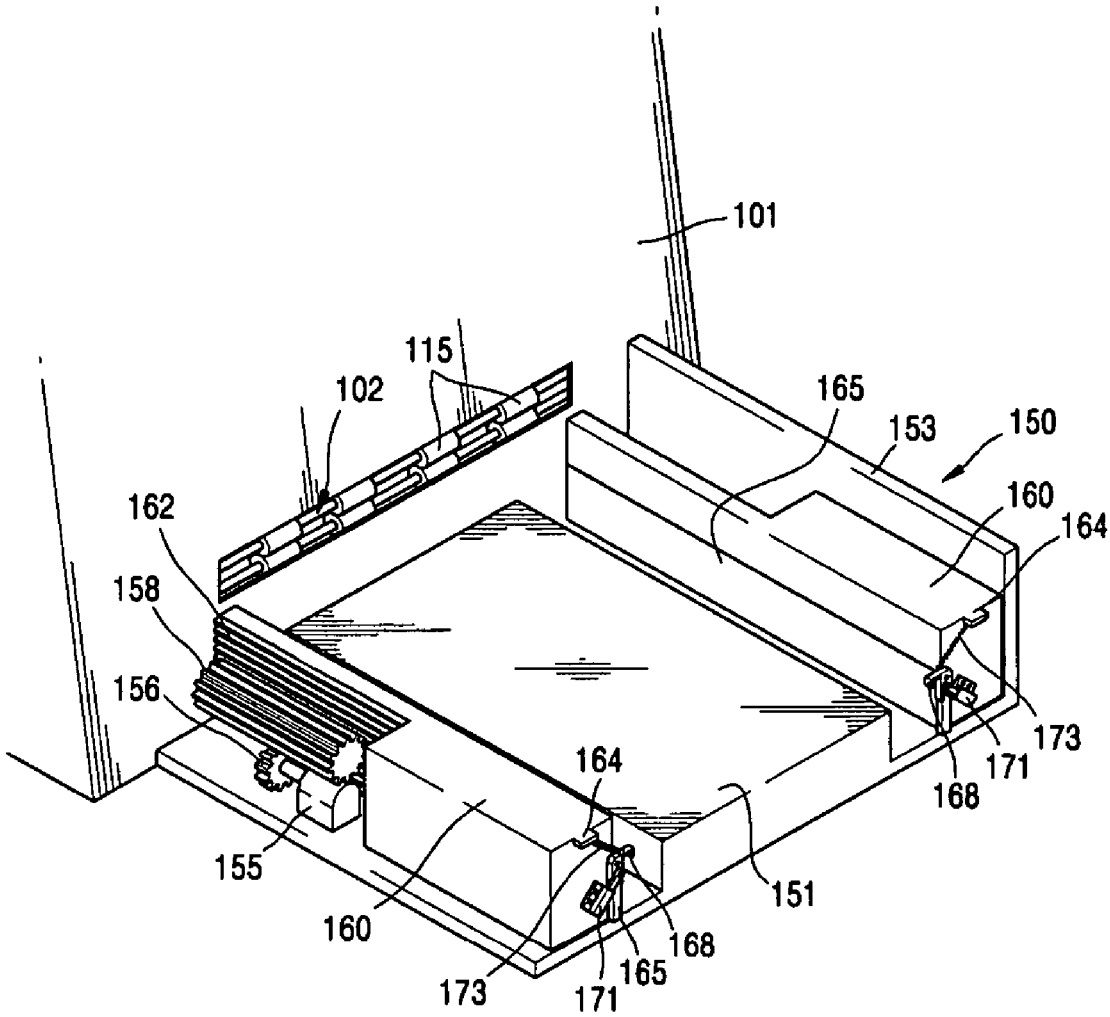
FIG. 3 is a partially cut away perspective view illustrating a document discharge cassette according to the preferable embodiment of the present invention.

FIG. 2 is a cross-sectional view illustrating an image scanner according to an embodiment of the present invention. FIG. 3 is a partially cut away perspective view illustrating a document discharge cassette according to the preferable embodiment of the present invention. FIGS. 4 to 8 are front views of a document discharge cassette shown in FIG. 3 and diagrams that sequentially describe the operation of the document discharge cassette.

An image scanner 100 includes a document feed cassette 130 to load a document to be scanned, a scanner body 101 to receive the document loaded at the document feed cassette 130, and a document discharge cassette 150 into which documents having been scanned are discharged into.

The scanner body 101 includes an image sensor 120 (e.g., a contact image sensor (CIS) or a charge coupled device (CCD) which scans images recorded on a document of the inside of a case 101). Further, the scanner body 101 includes an automatic document feed (ADF) roller 103 to serve as a document feeder and an ADF pad 103P which normally contacts with the ADF roller 103. The ADF roller 103 picks up and feeds documents that are loaded in a top position at the document feed cassette 130 one by one. The scanner body 101 may further include a pickup roller, which is not shown in FIG. 2, as a document feeder.

Further, the scanner body 101 includes a registration roller 105 to align a tip of the fed document and to correct a misalignment of the document, a first feed roller 107 to transfer the aligned document toward the image sensor 120, a second feed roller 109 to pass the image sensor 120 and to transfer the document of which one face opposite to the image sensor is scanned, and a document discharge roller 115 to discharge the document of which an image is scanned.

Further, the scanner body 101 includes a path changer 117 to change a document path to a duplex path 119 to scan a second face of the document and a duplex roller 111 to transfer the document advanced into the duplex path 119 along the duplex path 119.

When the image scanner 100 is in a double-face scanning mode, a first document in a top position at the document feed cassette 130 is fed to the scanner body and passes the registration roller 105, the first feed roller 107 and image sensor 120 in this order, and a first face 1-*i*, i.e., an upward facing face of the document at the time the first document 1 is loaded to the document feed cassette 130, is scanned.

The first document 1 of which the first face is scanned is transferred toward the document discharge roller 115 by the second feed roller 109. The document discharge roller 115 rotates in the direction opposite to the appropriate discharging direction with the first document 1 interposed between rollers of the document discharge roller 115. At this time, the duplex path 119 is opened by the path changer 117. Thus, the first document 1 may be advanced into the duplex path 119.

The first document 1, having been advanced into the duplex path 119, passes through the image sensor 120 after passing the duplex roller 111 and the first feed roller 107, and the second face 1-*ii*, that is, a reverse face of the first face 1-*i* is scanned. The first document 1, of which the first and second faces 1-*i* and 1-*ii* are scanned, is then discharged into the document discharge cassette 150 through the document discharge exit 102 via the second feed roller 109 and the document discharge roller 115.

Second and third documents 2 and 3, loaded under the first document 1 at the document feed cassette 130, pass sequentially through a substantially similar transfer path as the first document 1, the respective first and second faces 2-*i*, 2-*ii*, 3-*i*, and 3-*ii* are scanned, and the documents 2 and 3 are then discharged into the document discharge cassette 150 through the document discharge exit 102.

According to an embodiment of the invention, each document passes through the duplex path 119 once at the inside of the scanner body 101 and is discharged into the document discharge cassette 150 after passing the image sensor 120 only twice, that is, one time per side. Therefore, an upward face and a downward face of the document loaded at the document feed cassette 130 and fed into the scanner body face the same direction once the document is discharged into the document discharge cassette 150 through the document discharge exit 102. That is, the upward facing face of the document 1 when the document 1 is loaded into the document feed cassette 130 is the upward facing face of the document 1 when the document 1 is discharged into the document discharge cassette 150. Moreover, upward faces of each of the documents 1, 2, 3 at the document feed cassette 130 and the document discharge cassette 150 are the first faces 1-*i*, 2-*i*, and 3-*i* and the downward faces are the second faces 1-*ii*, 2-*ii*, and 3-*ii*, respectively.

According to an embodiment of the invention and unlike the conventional image scanners, here, a preceding discharged document is stacked on top of a following discharged document. In order to provide for this result, the document discharge cassette 150 comprises the following structure.

Referring to FIG. 3, the document discharge cassette 150 includes a base 151 which is positioned under the document discharge exit 102 through which a document may be discharged. The base 151 is provided at the outside of the case 101. The document discharge cassette further includes a document lift to cause a discharged document to ascend and descend at appropriate time in order to allow for following discharged documents to be placed at the base 151 in a correct order.

The document lift includes a pair of lift bodies 160 to cause a discharged document to ascend and descend. The lift bodies 160 are provided at both sides of the base 151. A pair of document support plates 165, coupled to the lift body 160, rotate about a hinge shaft 167 seen in FIG. 4.

A pinion gear 158 that may rotate clockwise and counterclockwise is provided at one side of the lift body 160. A rack gear 162, to be engaged with the pinion gear 158, is provided at the lift body 160, in order to ascend and descend the lift body 160, in response to the rotation of the pinion gear 158. The pinion gear 158 rotates because the pinion gear is engaged with a driving gear 156 that is rotated by a drive force of a motor 155. Ascent and descent of the lift body 160 is guided by a guide wall 153.

A clip 168 of the document support plate 165 is coupled to a front end of the hinge shaft 167. An actuator 171 and a spring 173 are coupled to a first branch (168*a* of FIG. 4) and a second branch (168*b* of FIG. 4) of the clip 168, respectively.

The actuator 171 includes a body (171*a* of FIG. 4) fixed on the front side of the lift body 160 and a stick (171*b* of FIG. 4) that is inserted into the body 171*a* to provide for linear reciprocating motion. The tip of the stick 171*b* is coupled to the first branch 168*a* of the clip 168. A solenoid (not shown) is provided at the inside of the body 171*a* and the tip of the stick 171*b* is pulled toward the body 171*a* if the solenoid is activated. Accordingly, the document support plate 165 is rotated to a first position in which the document support plate 165 is folded toward the lift body 160.

On the other hand, an end of the spring 173 is connected to the second branch 168*b* of the clip 168 while the other end of the spring is connected to a front projecting portion 164 of the lift body 160. Thus, the spring 173 elastically supports the document support plate 165 toward the second position in which the document support plate 165 is extended from the lift body 160.

Now, the operation of the document discharge cassette 150 and a document scanning method having the document discharge cassette 150 attached thereto will now be described with reference to FIGS. 4 to 8.

Figure 4:
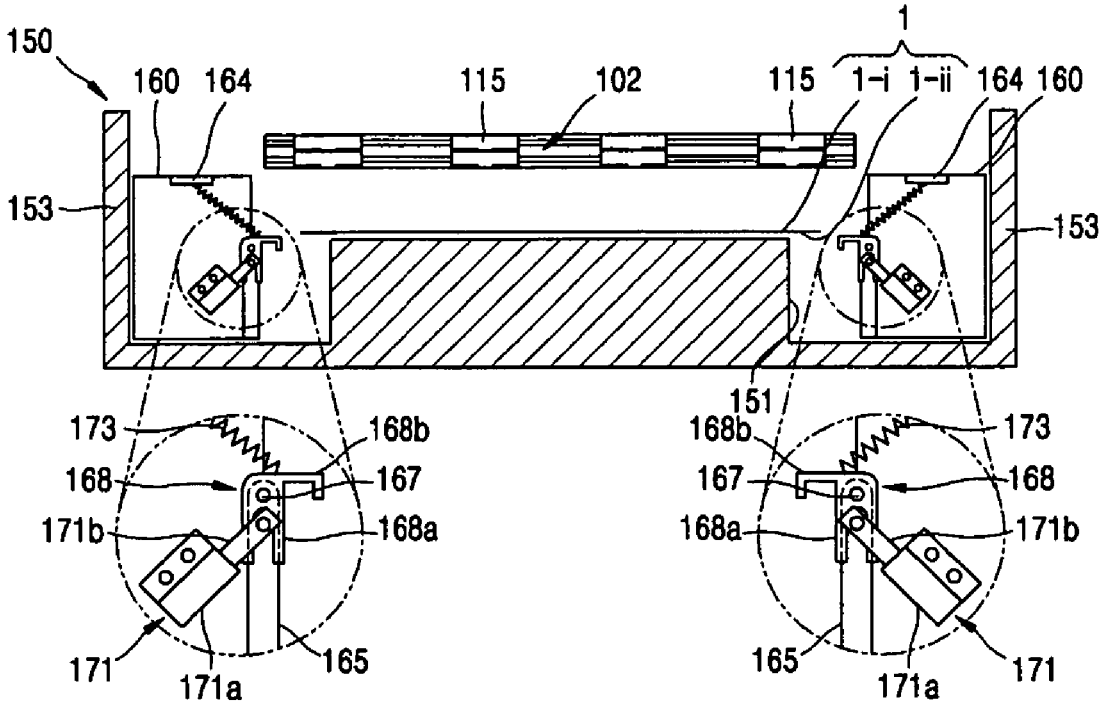
FIGS. 4 to 8 are front views of a document discharge cassette shown in FIG. 3 and diagrams sequentially describing the operation of the document discharge cassette.

Referring to FIG. 4, the first document 1 that is discharged through the document discharge exit 102 is allowed to descend such that the document 1 is placed at the base 151 after both faces of the document 1 are scanned in the image scanner (100 of FIG. 2). Both sides of the first document 1 are not in contact with the base 151 because a width of the base 151 is narrower than that of the first document 1. As described in referring to FIG. 2, the first face 1-*i* and the second face 1-*ii*, i.e., the upward facing face and the downward facing face of the document 1 when the document 1 was loaded into the document feed cassette 130 remain the upward facing face and the downward facing face of the first document 1, respectively.

Figure 5:
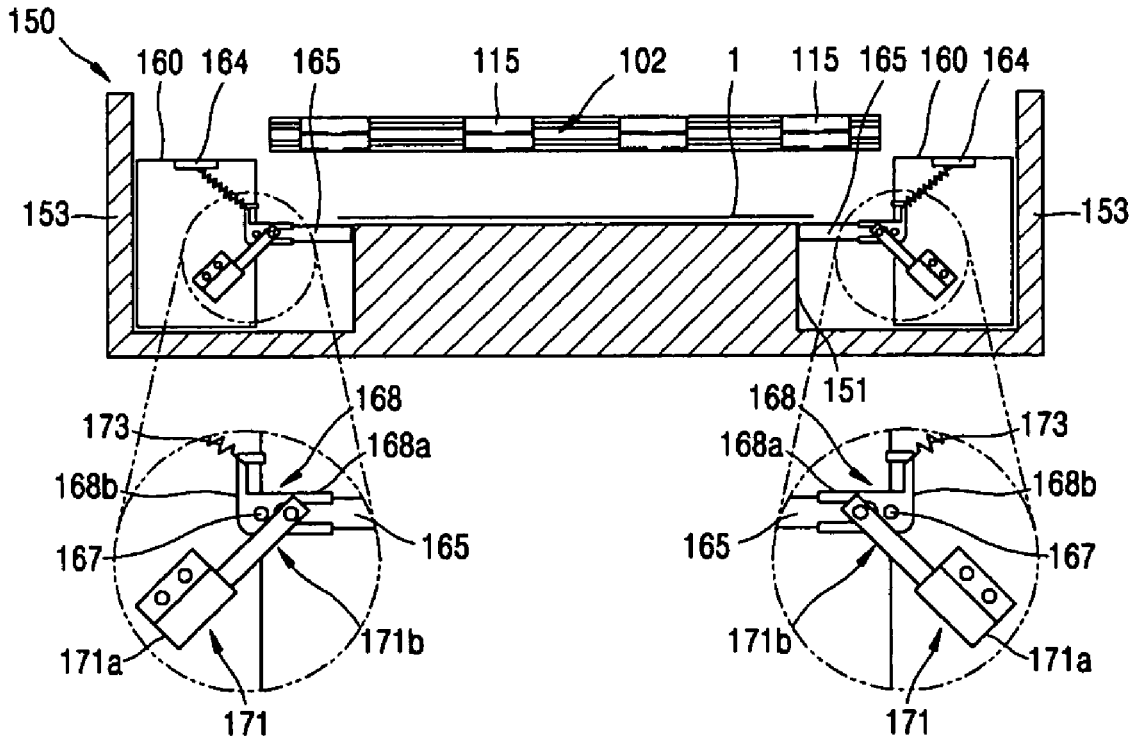

The document support plate 165 is positioned in the first position by an activation of the actuator 171. As a result, the document support plate 165 is folded so that the first document 1, having been discharged from the document discharge exit 102, may descend. Next, if the actuator 171 is not provided with the power, as shown in FIG. 5, the document support plate 165 is rotated to the second position and supports both sides of the first document 1 as a result of the elastic restoring force of the spring 173 acting on the document support plate 165 alone.

Figure 6:
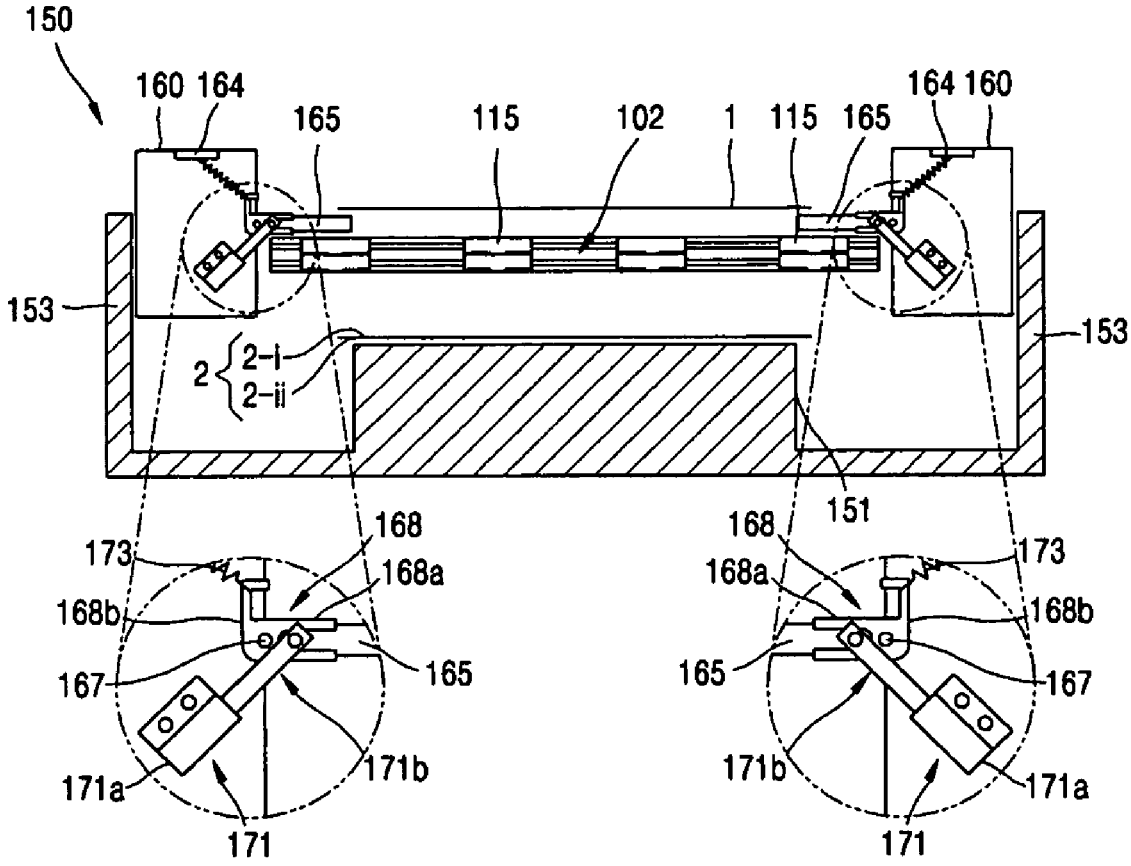

Next, as shown in FIG. 6, the lift body 160 is made to ascend as a result of a rotation of the pinion gear (158 of FIG. 3). The ascended height of the lift body 160 is sufficient to allow the first document 1 to be positioned higher than the document discharge exit 102. The second document 2 is discharged and is placed at the base 151 when the first document 1 is ascended as described above. The second document 2 having been discharged after the first document 1 is, therefore, a following document while the first document 1 is, therefore, a preceding document. The first face 2-*i* and the second face 2-*ii* of the second document 2 become an upward face and a downward face, respectively as in the first document 1.

Figure 7:
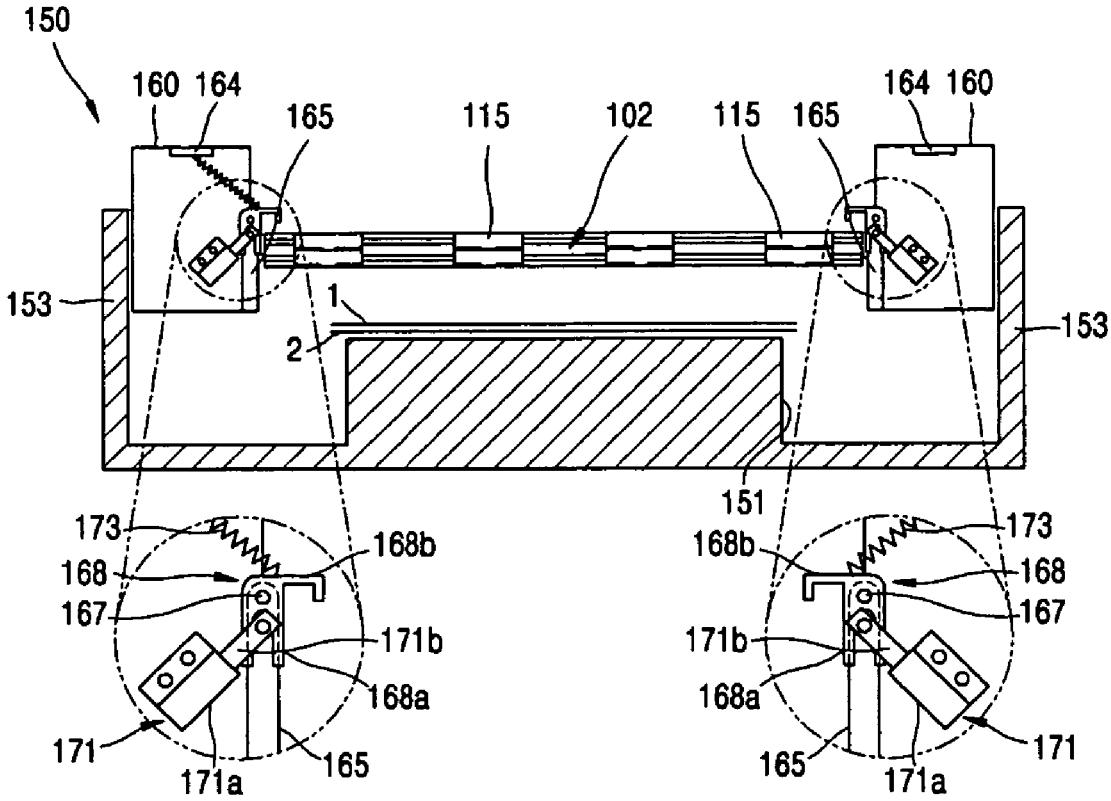
Figure 8:
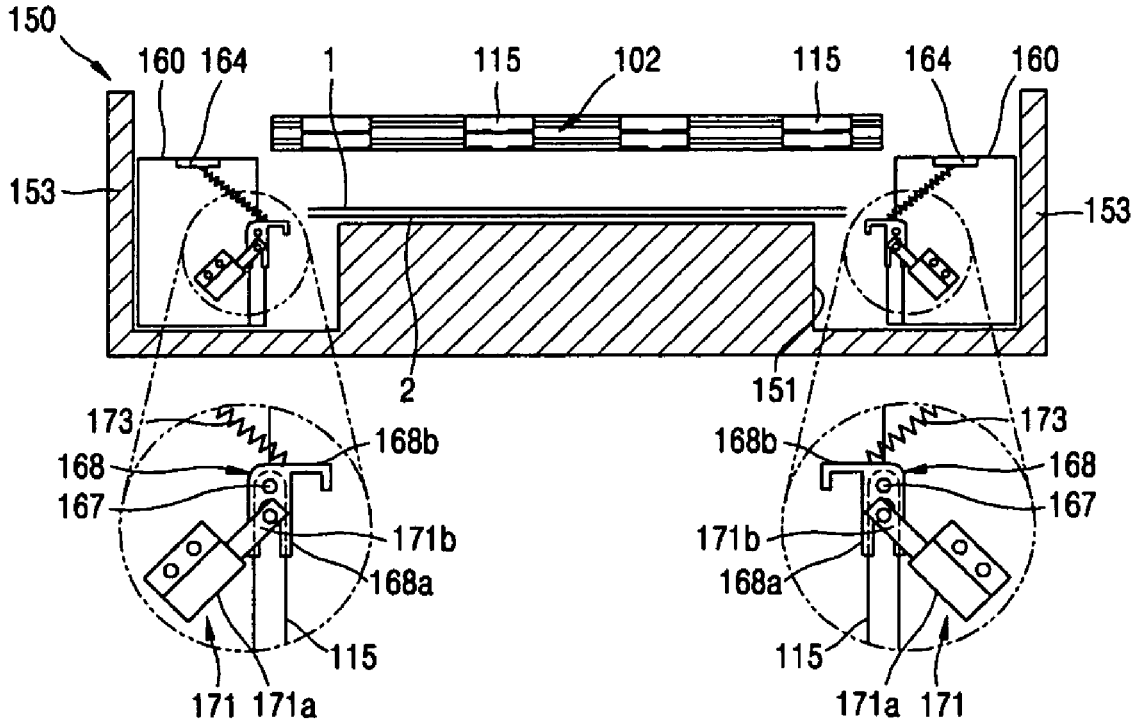

Next, as shown in FIG. 7, if the actuator 171 is activated again, the first document 1 is made to descend and is stacked on the second document 2 as a result of the document support plate 165 being rotated to the first position again. Next, as shown in FIG. 8, the pinion gear (158 of FIG. 3) is rotated in the direction opposite to the ascending direction of the lift body 160 and the lift body 160 is descended.

As is described in FIGS. 5 to 8, the operation of the document discharge cassette 150 is repeated so as to stack the third document (3 of FIG. 2) having been discharged after the second document 2, under the second document 2. In this case, the first document 1 and the second document 2 acting as preceding documents are made to descend after being made to ascend by the document lift and the third document 3 becomes a following document.

The document discharge cassette may stack a following discharged document under a preceding discharged document. Further, a speeding up of scanning of both faces of a document is possible because the document is only required to pass through a duplex path once when scanning both faces of the document with the image scanner having the document discharge cassette attached thereto. Further, reducing electric power consumption and a jam by shortening a transfer path of the document is possible.

Further, it is understood that the discharge cassette according to the present invention, may be applied to various apparatuses such as image scanners, copiers, fax machines, etc., or any combinations thereof. That is, where the apparatus operates on both faces of a document, the document may still be discharged from the apparatus after only one pass through of a duplex path in the apparatus because of the use of the document discharge cassette according to the present invention.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A document discharge cassette, comprising:

a base, positioned under a document discharger through which documents are discharged face up, on which the discharged documents are stacked; and a document lift to lift a preceding discharged document higher than the document discharger relative to the base and to lower the preceding document on a following document that is discharged after the preceding document and placed at the bases;

wherein the document lift comprises:

a pair of lift bodies to ascend and descend at both sides of the base; and a pair of document support plates coupled to each of the respective lift bodies with a hinge that rotates to a first position in which the document support plates are folded toward the respective lift bodies so that the document descends toward the base and a second position in which the document support plates are extended so that the document is supported above.

2. The document discharge cassette according to claim 1, further comprising a pinion gear to rotate clockwise and counterclockwise and a rack gear, provided at the lift body, to engage with the pinion gear, in order to cause the pair of lift bodies to ascend and descend.

3. The document discharge cassette according to claim 1, further comprising a pair of actuators to rotate each document support plate from the second position to the first position when activated.

4. The document discharge cassette according to claim 3, further comprising a pair of springs to restore each document support plate to the second position by an elastic force thereof.

5. An image scanner to which the document discharge cassette, according to claim 1, is attached, the scanner comprising: a document feed cassette to load a document to be scanned; and a scanner body to receive the document loaded at the document feed cassette.

6. The scanner according to claim 5, wherein the scanner body comprises:

an image sensor to scan an image recorded on the document;

an automatic document feed (ADF) roller to serve as a document feeder; and an ADF pad which normally contacts with the ADF roller, wherein the ADF roller picks up and feeds documents that are loaded in a top position at the document feed cassette one by one.

7. The scanner according to claim 6, wherein the scanner body further comprises:

a registration roller to align a tip of the fed document and to correct a misalignment of the document;

a first feed roller to transfer the aligned document toward the image sensor;

a second feed roller to pass the image sensor and to transfer the document of which one face opposite to the image sensor is scanned; and a document discharge roller to discharge the document on which the image is scanned.

8. The scanner according to claim 7, wherein the scanner body further comprises:

a path changer to change a document path to a duplex path to scan a second face of the document; and a duplex roller to transfer the document advanced into the duplex path along the duplex path.

9. The scanner according to claim 8, wherein when the image scanner is in a double-face scanning mode, a first document in a top position at the document feed cassette is fed to the scanner body and sequentially passes the registration roller, the first feed roller and the image sensor, and wherein a first face of the first document, which faced upward at the time the first document is loaded to the document feed cassette, is scanned.

10. The scanner according to claim 9, wherein the first document, having had the first face thereof scanned, is transferred toward the document discharge roller by the second feed roller, wherein, with the duplex path opened by the path changer, the document discharge roller rotates in the direction opposite to the appropriate discharging direction so that the first document is advanced into the duplex path.

11. The scanner according to claim 10, wherein a second face of the first document once the first document has been advanced into the duplex path passes through the image sensor after passing the duplex roller and the first feed roller so as to be scanned.

12. The scanner according to claim 11, wherein the first document, having had the first and second faces thereof scanned, is discharged into the document discharge cassette.

13. The scanner according to claim 5, wherein scanned documents pass through a duplex path of the scanner body once per side.

14. An image scanner comprising a document feed cassette loading a document to be scanned, a scanner body scanning both faces of the loaded document, and a document discharge cassette into which the document is discharged, wherein the document discharge cassette comprises:

a base, positioned under a document discharge exit provided at the scanner body and through which scanned documents are discharged, on which the discharged documents are stacked; and a document lift to lift a preceding document that is discharged through the document discharge exit higher than the document discharge exit relative to the base and to lower the preceding document on a following document that is discharged after the preceding document and placed at the base;

wherein the document lift comprises:

a pair of lift bodies to ascend and descend at both sides of the base; and a pair of document support plates coupled to each of the respective lift bodies with a hinge that rotates to a first position in which the document support plates are folded toward the lift bodies so that the document descends toward the base and a second position in which the document support plates are extended so that the document is supported above.

15. The image scanner according to claim 14, further comprising a pinion gear to rotate clockwise and counterclockwise and a rack gear, provided at the lift body, to engage with the pinion gear, in order to cause the pair of lift bodies to ascend and descend.

16. The image scanner according to claim 14, further comprising an actuator to rotate the document support plate from the second position to the first position when activated.

17. The image scanner according to claim 16, further comprising a spring to restore the document support plate to the second position by an elastic force thereof.

18. The image scanner according to claim 14, wherein the scanner body comprises an image sensor facing a face of the document to scan an image recorded on the face, and wherein the document passes the image sensor only two times to scan both faces of the document and is discharged into the document discharge cassette.

* * * * *